US011039255B2

(12) United States Patent
Ghis et al.

(10) Patent No.: US 11,039,255 B2
(45) Date of Patent: Jun. 15, 2021

(54) WIDE-PASSBAND CAPACITIVE VIBRATING-MEMBRANE ULTRASONIC TRANSDUCER

(71) Applicant: COMMISSARIAT A L'ENERGIE ATOMIQUE ET AUX ENERGIES ALTERNATIVES, Paris (FR)

(72) Inventors: Anne Ghis, Grenoble (FR); Marc Delaunay, Grenoble (FR)

(73) Assignee: COMMISSARIAT A L'ENERGIE ATOMIQUE ET AUX ENERGIES ALTERNATIVES, Paris (FR)

( * ) Notice: Subject to any disclaimer, the term of this patent is extended or adjusted under 35 U.S.C. 154(b) by 11 days.

(21) Appl. No.: 16/723,312

(22) Filed: Dec. 20, 2019

(65) Prior Publication Data

US 2020/0374636 A1 Nov. 26, 2020

(30) Foreign Application Priority Data

Dec. 23, 2018 (FR) ..... 18 74085

(51) Int. Cl.
*H04R 19/02* (2006.01)
*B06B 1/02* (2006.01)

(52) U.S. Cl.
CPC ..... *H04R 19/02* (2013.01); *B06B 1/0261* (2013.01); *B06B 1/0292* (2013.01)

(58) Field of Classification Search
CPC ... H04R 1/40; H04R 7/06; H04R 7/10; H04R 7/16; H04R 7/18; H04R 19/00; H04R 19/005; H04R 19/01; H04R 19/013; H04R 19/016; H04R 19/02; H04R 19/04; H04R 2201/00; H04R 2201/003; H04R 2201/40; H04R 2201/401; B81B 3/0021;
(Continued)

(56) References Cited

U.S. PATENT DOCUMENTS

2011/0026367 A1 2/2011 Noelle
2013/0116568 A1* 5/2013 Certon ..... A61B 8/145 600/447
2017/0260041 A1 9/2017 Ghis et al.

FOREIGN PATENT DOCUMENTS

WO WO 00/05001 A1 2/2000

OTHER PUBLICATIONS

French Preliminary Search Report dated Oct. 15, 2019 in French Application 18 74085 filed on Dec. 23, 2018 (with English Translation of Categories of Cited Documents and Written Opinion), 10 pages.

* cited by examiner

*Primary Examiner* — Walter F Briney, III
(74) *Attorney, Agent, or Firm* — Oblon, McClelland, Maier & Neustadt, L.L.P.

(57) ABSTRACT

A capacitive vibrating-membrane ultrasonic transducer includes a carrier with a cavity, a vibrating membrane fastened to the carrier and covering the cavity, and a conductive element separated from the membrane by the cavity. The vibrating membrane has a resonant frequency in membrane mode fm and a resonant frequency in plate mode fp according to the relationship fm>fp. An exciting circuit has terminals connected to the vibrating membrane and the conductive element, and is configured to apply, across its terminals, an electrical signal the maximum frequency fo according to the relationship fm>1.5*fo; or a measuring circuit is connected to the vibrating membrane and the conductive element and configured to measure capacitance variations up to a frequency fo.

12 Claims, 4 Drawing Sheets

(58) Field of Classification Search
CPC ..... B81B 3/0067; B81B 2201/02; B81B 2201/0221; B81B 2201/0257; B81B 2203/0127; B81B 2203/053; B81B 2207/05; B81B 2207/053; B81B 2207/07
See application file for complete search history.

[Fig. 1]
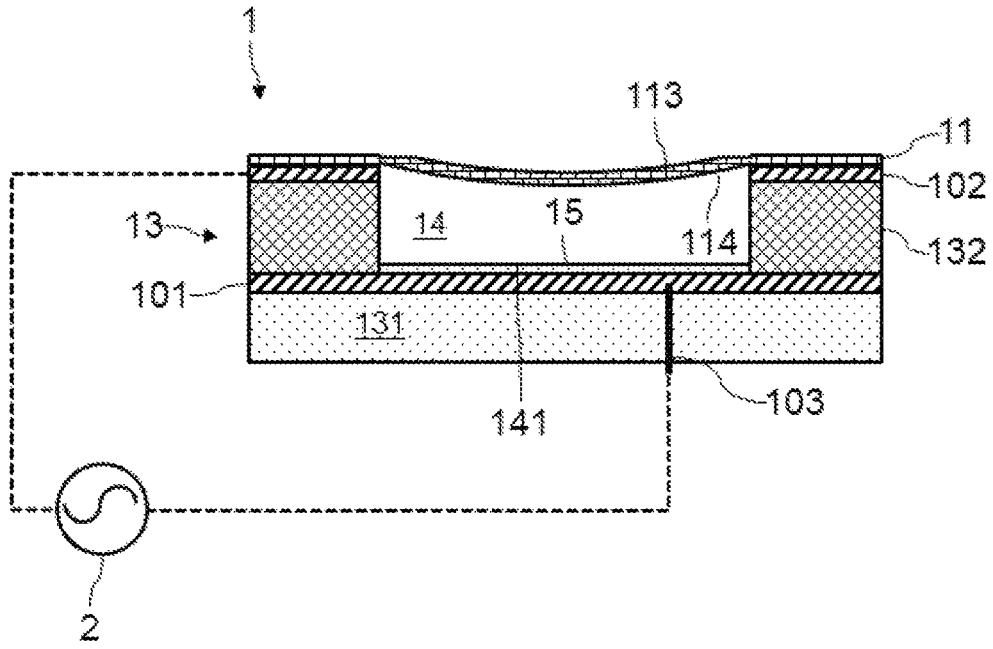
[Fig. 2]
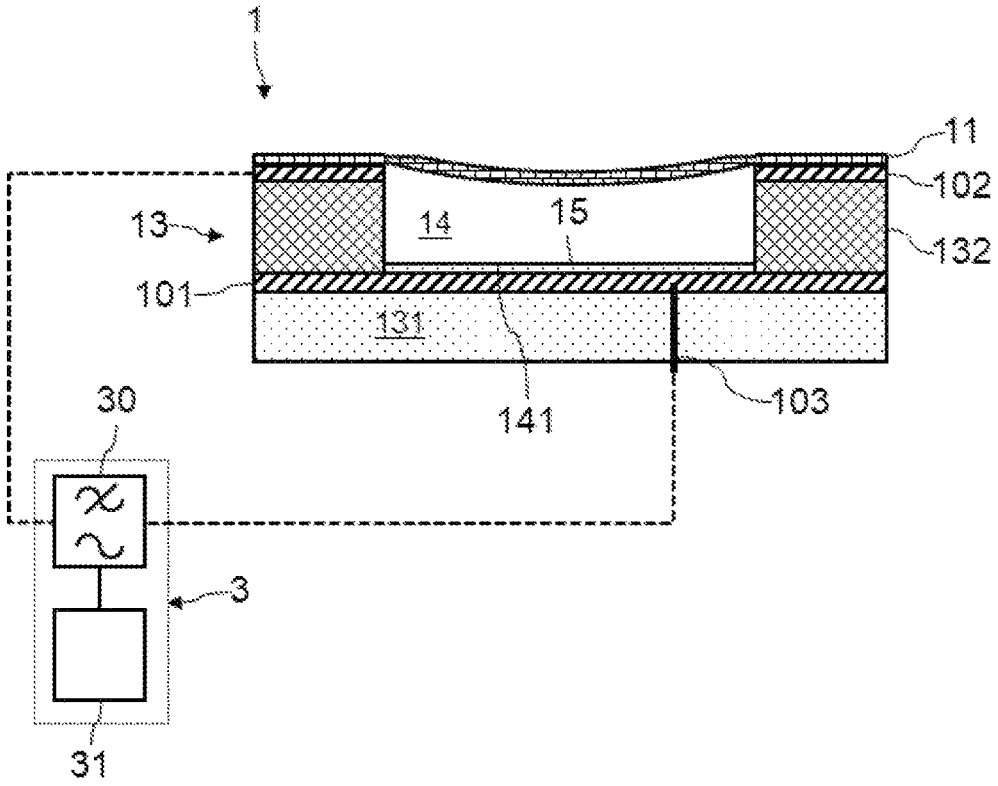

[Fig. 3]
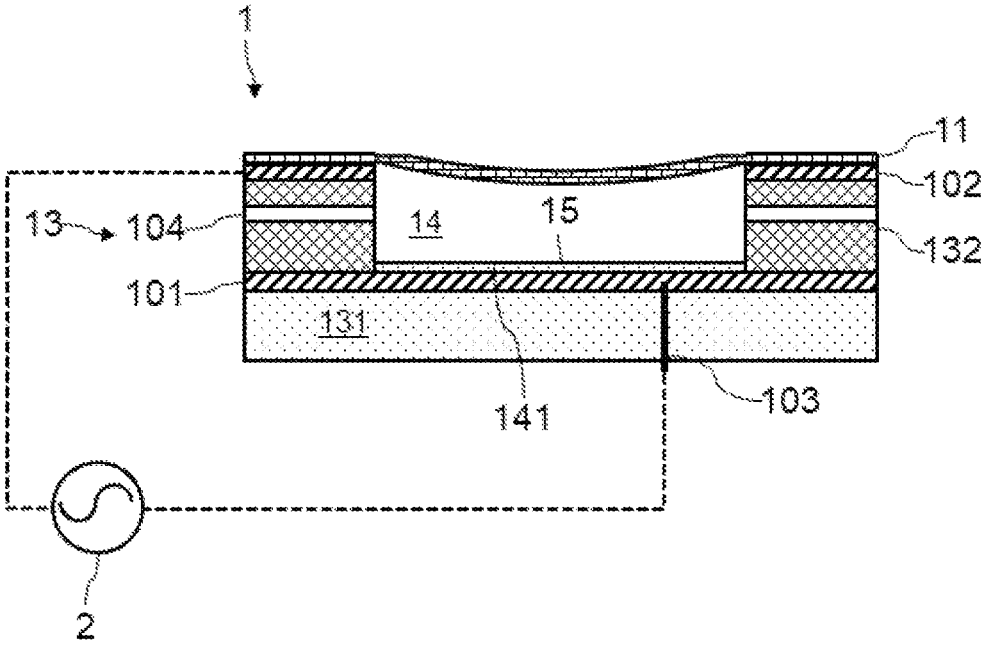
[Fig. 4]
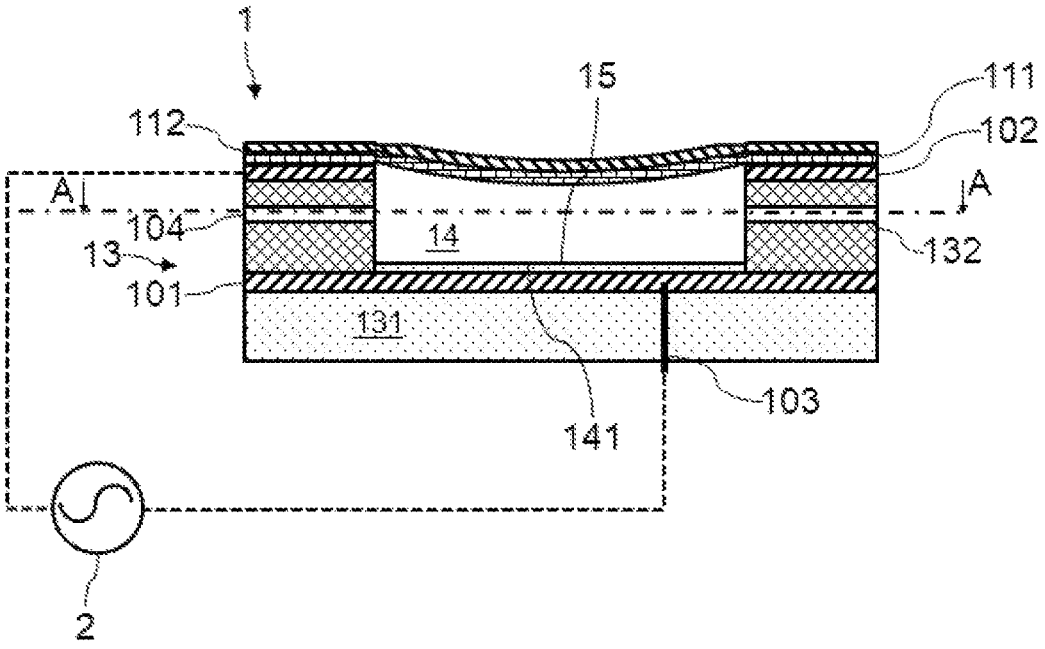

[Fig. 5]
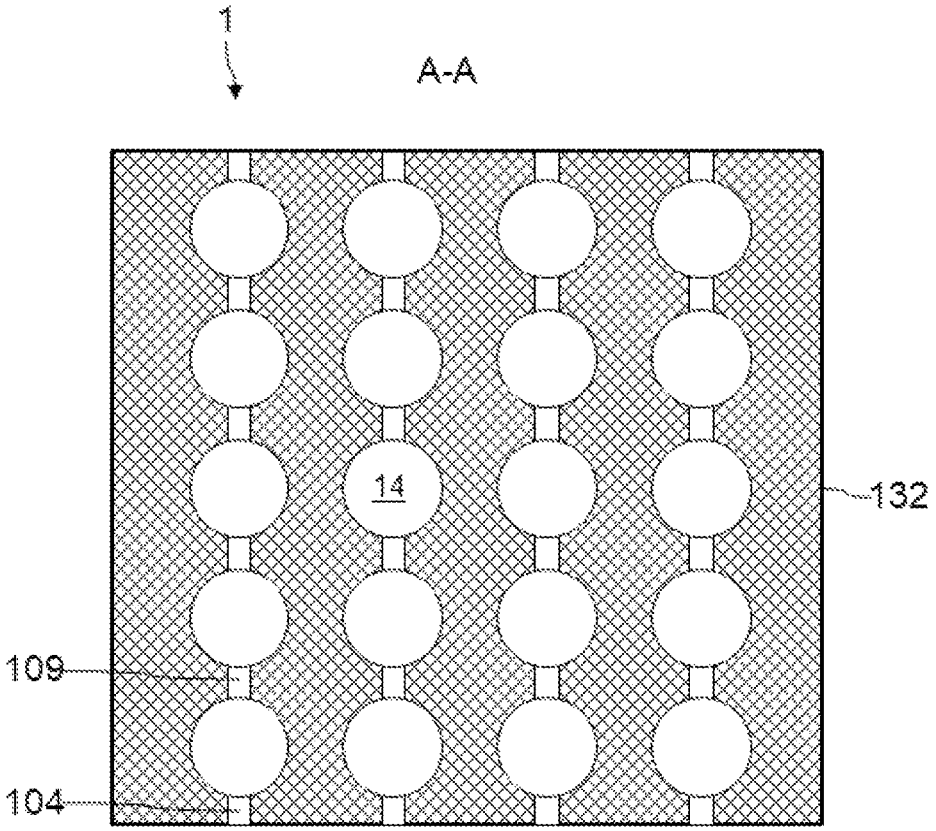
[Fig. 6]
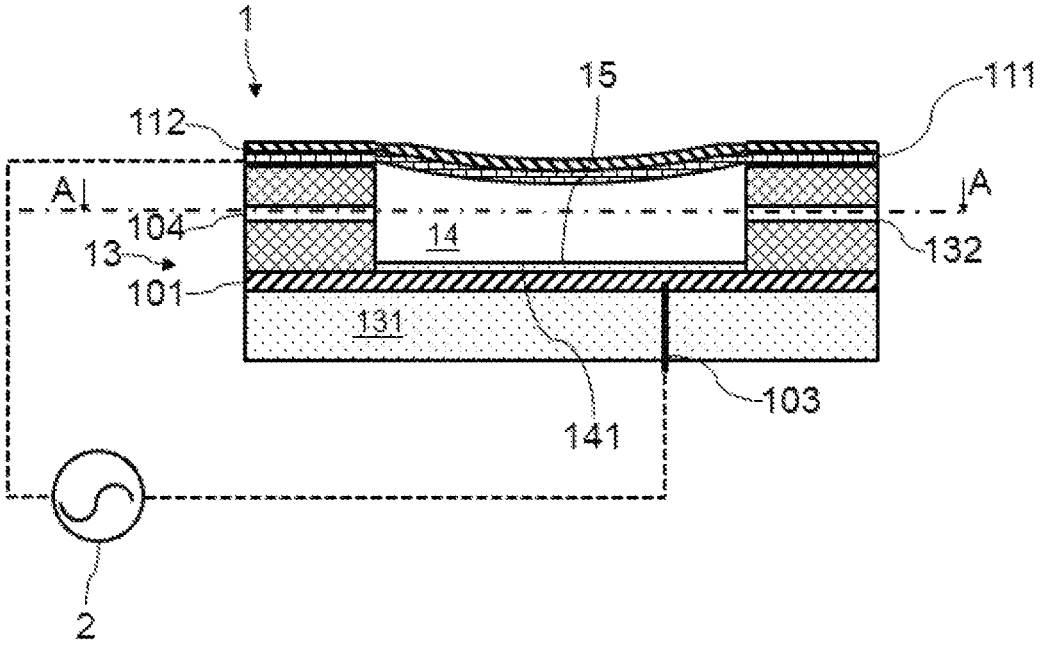

[Fig. 7]
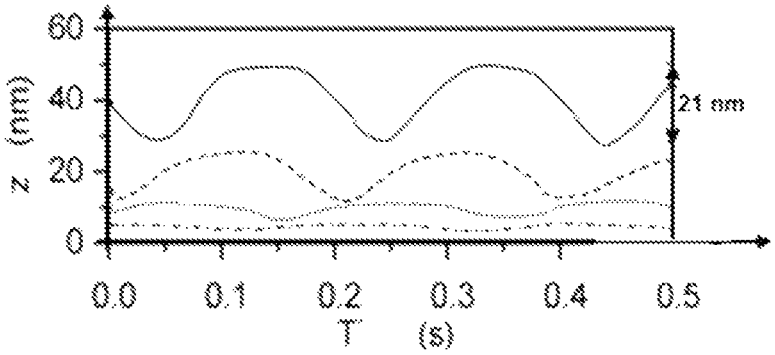

WIDE-PASSBAND CAPACITIVE VIBRATING-MEMBRANE ULTRASONIC TRANSDUCER

The invention relates to acoustic transducers that operate in the ultrasound range and in particular to transducers of this type that are capacitive and comprise a vibrating membrane. Description Ultrasonic waves are pressure waves the frequency range of which starts at 20 kHz and extends up to a few tens of MHz. Ultrasonic waves propagate at a speed that depends on the propagation medium: about 343 m/s in air and 1500 m/s in water. The waves undergo, as they propagate, absorption at a rate that increases with their frequency. Moreover, when the wave encounters a discontinuity in the propagation medium, some of the wave is transmitted and some is reflected.

Various applications use ultrasonic transducers with a view to:

- creating an absorption of ultrasonic waves, for example in order to heat material locally;
- emitting and receiving waves, for example for an application to the transmission of information;
- analysing the reflection of waves from obstacles, for example for an application to range finding.

In such applications, there is an increasing need for miniaturized electroacoustic transducers for propagating ultrasound through fluid media. In a fluid, an acoustic wave is generated by the movement of a movable surface. At the movable surface, the acoustic intensity of the source is equal to the impedance of the medium multiplied by the square of the speed of the movable surface. For a given frequency, the larger the amplitude of the movements of the movable surface of the transducer, the greater the intensity of the source.

Vibrating-membrane transducers are being developed for miniaturized applications. Such transducers include membranes that are suspended above cavities that are produced in a carrier or that are open. The diameter of circular cavities is generally comprised between a few tens of and a few hundred microns. The thickness of such membranes is generally larger than 50-100 nm and up to several microns. The resonant frequency of the complete device depends on the geometry of the cavity/membrane assembly and on the materials used.

One particular case of a vibrating-membrane transducer is the capacitive vibrating-membrane transducer. The membrane of an emitter is for example subjected to an electrostatic force by applying an alternating potential difference across this membrane and a conductive electrode housed at the bottom of the cavity. For a detector, the value of the capacitance formed between the membrane and the electrode housed at the bottom of the cavity is determined at any given time by the deformation of the membrane, and therefore by the instantaneous pressure incident on the membrane. Detection involves measuring the variations in this capacitance.

The movement of the membrane is maximum at the resonant frequency of this membrane. Emission intensity is therefore maximum at the resonant frequency of the membrane. The same goes for the detection of a wave: the sensitivity of the sensor is maximum at the resonant frequency of its membrane.

Ultrasonic transducers are therefore generally associated with an optimal operating frequency that is determined by the resonance of their membrane. The quality factor of the mechanical resonator including the membrane determines the passband of the transducer. A bandwidth is conventionally bounded by frequencies corresponding to a decrease of half in the acoustic intensity with respect to resonance, on either side of this resonant frequency. The widest passbands may be of the same order of magnitude as the resonant frequency: for example, a transducer of resonant frequency of 1 MHz with a bandwidth of 600 kHz, i.e. a passband extending from 700 kHz to 1300 kHz, is considered to be a wide-band transducer. Outside of the passband, the amplitudes of vibration may be lower by several orders of magnitude than the amplitudes at resonance.

This resonant operating mode implies that each application requires a specific transducer, because very different ultrasonic frequencies cannot be covered by one and the same transducer: the detection of obstacles is typically carried out at 40 kHz with a range of a few metres in air, the capture of gestures is carried out between 100 kHz and 400 kHz with a range of a few tens of centimetres in air, the detection of fingerprints is carried out between 1 MHz and 10 MHz with a millimetric range in a nonuniform medium, and ultrasonic medical imaging uses frequencies between 5 MHz and 50 MHz in aqueous-type media.

Document WO2012010786 describes a capacitive vibrating-membrane ultrasonic transducer. In this transducer, a cavity of a carrier is kept under vacuum under a membrane. The document suggests making the transducer operate at a frequency below the resonant frequency and considering a wider range of operating frequencies, with the performance level varying depending on the frequency used.

There is therefore a need for transducers having wider frequency bands of use to be designed. Moreover, in range-finding applications, there is a need to minimize the blind spot found in close proximity.

The invention aims to solve one or more of these drawbacks. The invention thus relates to a capacitive vibrating-membrane ultrasonic transducer such as defined in the appended claims.

The invention also relates to the variants in the dependent claims. Those skilled in the art will understand that each of the features of the dependent claims and of the description may be independently combined with the features of an independent claim, without however constituting an intermediate generalization.

Other features and advantages of the invention will become clear from the nonlimiting description that is given thereof below, by way of indication, with reference to the appended drawings, in which:

FIG. 1 is a schematic cross-sectional view of a vertical plane of an example of a capacitive vibrating-membrane ultrasonic transducer according to one embodiment of the invention;

FIG. 2 is a schematic cross-sectional view of a vertical plane of an example of a capacitive vibrating-membrane ultrasonic transducer according to another embodiment of the invention;

FIG. 3 is a schematic cross-sectional view of a vertical plane of an example of a capacitive vibrating-membrane ultrasonic transducer according to another embodiment of the invention;

FIG. 4 is a schematic cross-sectional view of a vertical plane of an example of a capacitive vibrating-membrane ultrasonic transducer according to another embodiment of the invention;

FIG. 5 is a schematic cross-sectional view of a horizontal plane of a matrix array of ultrasonic transducers according to the embodiment of FIG. 4;

FIG. 6 is a schematic cross-sectional view of a vertical plane of an example of a capacitive vibrating-membrane ultrasonic transducer according to another embodiment of the invention;

FIG. 7 is a graph illustrating the results of measurements of amplitudes of vibration in air of a membrane for various exciting voltages.

FIG. 1 is a schematic cross-sectional view of a vertical plane of an example of a capacitive vibrating-membrane ultrasonic transducer 1 according to a first embodiment of the invention. The transducer 1 comprises a carrier 13 in which a cavity 14 is produced. The cavity 14 is for example cylindrical. In the illustrated example, the carrier 13 notably includes a substrate 131 taking the form of a plate, and a dielectric layer 132 also taking the form of a plate. In the illustrated example, the carrier 13 also includes a conductive element 101. The substrate 131 and the dielectric layer 132 are here fastened to the conductive element 101. The dielectric layer 132 comprises a bore defining the sidewalls of the cavity 14. The bore depth of the cavity 14 is smaller than the height of the layer 132 or of the two layers 132 and 102 together. The bottom 141 of the cavity 14 is thus advantageously delineated by a dielectric layer 15. One portion of the conductive element 101 is thus housed under the cavity 14, under the dielectric layer 15.

A vibrating membrane 11 is fastened to the carrier 13 and covers the cavity 14. The membrane 11 has an external upper face 113 and an internal lower face 114. The membrane 11 is placed facing the conductive element 101. The membrane 11 and the conductive element 101 are separated by the cavity 14 and the dielectric layer 15.

In the illustrated example, the membrane 11 is fastened to the dielectric layer 132 of the carrier 13 by way of an electrode 102. As detailed below, the electrode 102 is merely an optional component for exciting the membrane 11. The electrode 102 here takes the form of a plate. The electrode 102 is here fastened to an upper face of the dielectric layer 132 and has a similar shape thereto given that it is passed through by the same bore. The electrode 102 makes electrical contact with the membrane 11 on the periphery of the cavity 14.

The conductive element 101 forms an electrode of the transducer 1. An exciting circuit 2 has its terminals connected on the one hand to the electrode 102 and on the other hand to the conductive element 101. By applying an alternating potential across its terminals, the exciting circuit 2 allows an electric field to be created between the membrane 11 and the conductive element 101, this subjecting the membrane 11 to an electrostatic force and causing it to bow. The transducer 1 is therefore capacitive.

In linear regime, the movement d of the centre of the membrane 11 in a direction normal to its plane at rest is proportional to the applied force F and to the shear modulus of the membrane: F=D*d.

For a membrane 11 forming a plate, in the absence of tension:

$$D=E*h^3/12*(1\eta^2)$$

with E Young's modulus and η the Poisson's coefficient of the material of the membrane 11 and h its thickness.

In the mechanics of vibrations, theory allows different vibratory behaviours to be distinguished between depending on the geometry and design of the vibrating membrane 11.

To simplify, different one-dimensional objects, such as a beam and a rope, may firstly be analysed. A beam will have a behaviour and a resonant frequency that are mainly determined by its geometry (its length and its cross section) and the Young's modulus of the material from which it is made. The behaviour of a rope, for its part, will be essentially defined by its tension. The tauter the rope, the higher its resonant frequency.

Likewise, for two-dimensional objects, the following are both encountered:

- a behaviour of plate type, determined by the geometry of the object and its material. A resonant frequency fp is associated with this behaviour;
- a behaviour of membrane type, mainly defined by the tension in the object.

Another resonant frequency fm is associated with this behaviour.

The resonant frequency of the object is the quadratic sum of the resonant frequencies due to each of these two behaviours.

For a circular object of radius R embedded on its periphery, the resonant frequency fr is defined by the relationship:

$$fr(R)=\sqrt{(fm^2(R)+fP^2(R))}$$

The resonant frequency fm in membrane mode may notably be defined in this case by the following relationship, with T the tension of the object (in N/m) and s its density per unit area (in kg/m$^2$):

$$fm = \frac{2.405}{2\pi * R} * \sqrt{(T/S)} \quad \text{[Math.1]}$$

The resonant frequency fp in plate mode may notably be defined in this case by the following relationship, with p the density of the circular object (in kg/m$^3$):

$$fp = \frac{11.84}{R^2} * \sqrt{(E * h^2/\rho)} \quad \text{[Math.2]}$$

Those skilled in the art will be able to define, empirically or analytically, the resonant frequencies fp and fm for other vibrating-membrane geometries.

According to one preferred aspect of the invention, the vibrating membrane 11 of the transducer 1 respects the following relationship: fm>fp. Preferably, the vibrating membrane 11 of the transducer 1 respects the following relationship: fm>1.5*fp, and even more preferably fm>2.5*fp. The vibrating membrane 11 of the transducer 1 therefore has a membrane mode that is preponderant with respect to its plate mode. Advantageously, by satisfying this inequality, it is possible to place the membrane in a mode in which it exhibits significant movement far from resonance, i.e. in linear mode.

According to the invention, the exciting circuit 2 is configured to apply, across its terminals, a signal the frequency components of which are included in the frequency interval [0–fo], fo respecting the relationship f0<fr, and preferably fo<0.66*fr (i.e. fr>1.5*fo). Therefore, it may be deduced therefrom that f0<fr<fm. Thus, the membrane 11 is excited at a frequency clearly below its resonant frequency in membrane mode: the movements of the membrane are not caused by a resonance effect, but by a forced-oscillation mechanism, this allowing a wide range of usable excitation frequencies, extending from very low frequencies (a few hertz) up to 0.66*fr, and in which the level of performance remains constant, to be obtained. The same transducer 1 may thus be used for many different applications. Contrary to resonant excitations, the use of forced oscillations also allows short pulses to be generated and, therefore, for range-finding applications for example, blind spot to be minimized. The use of forced oscillations also allows the exciting power to be increased at constant frequency. Advantageously, the exciting circuit 2 is configured to apply, across its terminals, an exciting signal with a maximum frequency fo respecting the relationship fr>f0, and advantageously fr>1.5*fo.

Advantageously, the exciting circuit 2 is configured to apply, across its terminals, a signal such that the ratio between the total electrical power applied across these terminals and the electrical power applied in a frequency range comprised between 0.9*fr and 1.1*fr is at least equal to 10. Thus, most of the exciting power is applied outside of the resonant range.

The graph of FIG. 7 illustrates the results of measurement of amplitudes of vibration in air of a membrane for various exciting voltages. A membrane above a cavity of 2 μm was excited at fo=5 Hz with various exciting voltages. The fundamental resonance of this type of membrane is located at frequencies between 20 MHz and 30 MHz. The solid line corresponds to an exciting voltage of 16 V, the dashed line corresponds to an exciting voltage of 12 V, the dotted line corresponds to an exciting voltage of 8 V, and the dash-dotted line corresponds to an exciting voltage of 4 V. The amplitudes of deformation at 5 Hz are therefore in forced-oscillation mode, and these amplitudes increase with the exciting voltage, as this graph shows. Amplitudes of a few tens of nanometres were obtained for a cavity diameter of 2 μm. These very large deformations off resonance allow ultrasonic waves to be generated.

Ultrasonic waves were emitted experimentally between 20 kHz and 140 kHz by membranes of 15 nm thickness suspended above circular cavities of 10 μm diameter.

The components of the transducer 1 may have the following dimensions and compositions:

- the conductive element 101 may for example have a thickness comprised between 150 and 250 nm, of 200 nm for example. The conductive element 101 may for example be made of tungsten, of aluminum, of titanium, of copper, of gold or of a combination of these materials;
- the dielectric layer 132 may for example have a thickness comprised between 0.8 and 1.25 μm, 1 μm for example. The dielectric layer 132 may for example be made of $SiO_2$;
- the substrate 131 may for example be made of glass, of quartz, of alumina, of silicon covered with a dielectric layer or even of SiN;
- the cavity 14 may have a diameter comprised between 5 and 50 μm, 10 μm for example (defining the suspended length of the membrane 11);
- the electrode 102 may for example have a thickness comprised between 80 and 150 nm, of 100 nm for example. The electrode 102 may for example be made of tungsten, of aluminum, of titanium, of copper, of gold, or of any other conductive material or alloy. The electrode 102 may be formed by depositing a conductive material on an insulating carrier;
- the membrane 11 may for example have a thickness comprised between 5 and 25 nm, of 10 nm for example. The membrane 11 may for example comprise a layer of amorphous carbon. The membrane 11 may be fastened to the carrier 13 without tensile prestress.

Advantageously, the membrane 11 has a thickness at most equal to 100 nm. The membrane 11 may advantageously be intended to vibrate in the cavity 14 with an amplitude of at least 5% of the suspended length and lower than the depth of the cavity.

The diameter of the cavity 14 may be decreased in order to increase the resonant frequency of the membrane 11.

A continuous or very low frequency electrostatic force may be applied by the exciting circuit 2 in order to impose an initial mechanical tension on the vibrating membrane 11. The exciting circuit 2 will then apply, across the electrode 102 and the element 101, a potential difference with a continuous or very-low-frequency component (for example of frequency at most equal to 50 Hz) so as, inter alia, to allow the sensitivity and dynamic range of the transducer 1 to be modulated.

FIG. 2 is a schematic cross-sectional view of a vertical plane of an example of a capacitive vibrating-membrane ultrasonic transducer 1 according to a second embodiment of the invention. The transducer 1 comprises a carrier 13, a conductive element 101, an electrode 102 and a membrane 11 that are identical to those of the first embodiment. In this example, a measuring circuit 3 is electrically connected to the membrane 11 and the conductive element 101 (by way of the connecting via 103).

The measuring circuit 3 measures the charge movements related to the instantaneous variation in the capacitance between the electrode 102 and the element 101, which variation is induced by the vibrations of the membrane 11.

The measuring circuit 3 will also possibly apply, across the electrode 102 and the element 101, a potential difference with a continuous or very-low-frequency component (for example of frequency at most equal to 50 Hz) so as to be able to modulate the sensitivity and dynamic range of the transducer 1.

It is also possible to envision connecting an exciting circuit 2 and a measuring circuit 3 such as described above to the membrane 11 and conductive element 101. The exciting circuit 2 and the measuring circuit 3 may be connected selectively and independently by respective switches. It will then be possible to independently process the emission and reception of an acoustic signal, for example in order to implement a range-finding mode.

FIG. 3 is a schematic cross-sectional view of a vertical plane of an example of a capacitive vibrating-membrane ultrasonic transducer according to a third embodiment of the invention. The transducer 1 comprises an exciting circuit 2 (and may comprise in addition or instead a measuring circuit 3), a conductive element 101, an electrode 102 and a membrane 11 that are identical to those of the first embodiment. In this example, the carrier 13 comprises at least one duct 104 placing in communication the interior of the cavity 14 and the exterior of the transducer. The ducts 104 allow the cavity 14 of the transducer 1 (and therefore the internal face 114 of the membrane 11) to be placed in communication with the external face 113 of the membrane 11. It is thus possible to equilibrate the pressures on the faces 113 and 114 of the membrane 11 and to ensure that all the cavities are at the same pressure, in this case atmospheric pressure. The ducts 104 may also be replaced by grooves in the upper surface of the dielectric layer 132.

FIG. 4 is a schematic cross-sectional view of a vertical plane of an example of a capacitive vibrating-membrane ultrasonic transducer according to a fourth embodiment of the invention. In this example, the membrane 11 includes a plurality of superposed layers made of different materials. The membrane 11 thus includes a superposition of a layer 111 and of a layer 112 made of different materials. The layer 111 is for example made of a conductive material such as titanium. The layer 111 may for example have a thickness comprised between 3 and 7 nm, and typically of 5 nm. The layer 112 is for example made of amorphous carbon. The layer 112 may for example have a thickness comprised between 8 and 12 nm, and typically of 10 nm. Such a configuration proves to be an optimal way, on the one hand, of promoting the capacitive effect via the use of the conductive layer 111, and, on the other hand, of promoting the flexibility and durability of the membrane 11 via the use of the layer 112.

In the various examples, if the membrane 11 includes a conductive layer, it is possible not to interpose an electrode 102 between this membrane 11 and the circuits to which it is connected. In particular, in the following embodiment a membrane 11 including a combination of a conductive layer and of a layer chosen for its mechanical properties is described: the electrode 102 may be omitted if a circuit is directly connected to the conductive layer. This corresponds to the example of FIG. 6, in which the membrane 11 described with reference to FIG. 5 has been shown again.

FIG. 5 is a schematic cross-sectional view of a horizontal plane of a matrix array of ultrasonic transducers 1 according to the embodiment of FIG. 4. The transducers may be arranged in a matrix array of 500 by 500 transducers 1 along two perpendicular axes. A corresponding matrix array of cavities 14 is thus produced in a common dielectric layer 132. The cavities 14 of a given column of transducers 1 are placed in communication by way of ducts 109. At the ends of the matrix array, the transducers 1 are placed in communication with the exterior via ducts 104. Thus, the cavity of each transducer 1 is placed in communication with the external face of its membrane by way of the ducts 104, and 109 where appropriate. A given membrane 11 may be used to cover all of the cavities 14.

The pressure in the cavities 14 may also be different from the surrounding pressure. A peripheral seal may thus be employed if the various cavities 14 of the matrix array are placed in communication with one another.

In order to be able to orient the emission or reception beam, an array of transducers 1 may comprise a plurality of conductive elements 101 (for example arranged in parallel) and/or a plurality of electrodes 102 (for example in parallel). A plurality of channels may for example be formed. Parallel conductive elements 101 may be positioned perpendicular to the parallel electrodes 102. The elements of the array are thus defined by superposing an electrode 102 and a conductive element 101 and are individually addressable. The pitch between the conductive elements of 101 or 102 may be decreased to the pitch of the array of elementary transducers. A small elementary transducer diameter of 10 μm with a pitch of 15 μm for example allows beamforming to be carried out at up to more than 10 MHz in air.

The invention claimed is:

1. A capacitive vibrating-membrane ultrasonic transducer, comprising:

a carrier in which at least one cavity is produced;

a vibrating membrane fastened to the carrier and covering the cavity;

a conductive element separated from the membrane by the cavity;

wherein:

the vibrating membrane has a resonant frequency in membrane mode fm and a resonant frequency in plate mode fp according to the relationship fm>fp;

an exciting circuit has terminals connected to the vibrating membrane and the conductive element, and is configured to apply across its terminals an electrical signal the maximum frequency fo according to the relationship fr>fo, fr being a resonant frequency of the membrane; and/or a measuring circuit is connected to the vibrating membrane and the conductive element and configured to measure capacitance variations up to a frequency fr>fo.

2. The ultrasonic transducer according to claim 1, wherein the vibrating membrane is configured in accordance with the relationship fm>1.5*fp.

3. The ultrasonic transducer according to claim 1, wherein an exciting circuit has terminals connected to the vibrating membrane and to the conductive element, and is configured to apply, across its terminals, an electrical signal so that a ratio between the total electrical power applied across these terminals and the electrical power applied in a frequency range comprised between 0.9*fr and 1.1*fr is at least equal to 10.

4. The ultrasonic transducer according to claim 1, wherein an exciting circuit has terminals connected to the vibrating membrane and the conductive element, and is configured to apply, across its terminals, an electrical signal with the maximum frequency fo according to the relationship fr>5*fo.

5. The ultrasonic transducer according to claim 1, wherein said carrier places in communication an external face of the membrane with the cavity delineated by an internal face of the membrane.

6. The ultrasonic transducer according to claim 5, wherein a matrix array of cavities including said cavity is produced in the carrier, a plurality of said cavities being in communication, a respective conductive element being housed under each of said cavities, the ultrasonic transducer comprising a matrix array of vibrating membranes including said vibrating membrane and covering respective cavities.

7. The ultrasonic transducer according to claim 1, wherein said membrane has a thickness at most equal to 100 nm.

8. The ultrasonic transducer according to claim 1, wherein said membrane is a combination of a plurality of layers of different materials.

9. The ultrasonic transducer according to claim 1, wherein said membrane includes a layer of amorphous carbon.

10. The ultrasonic transducer according to claim 1 wherein said membrane includes a layer of titanium.

11. The ultrasonic transducer according to claim 1, furthermore comprising an electrode making electrical contact with the membrane and with the exciting circuit, or the measuring circuit.

12. The ultrasonic transducer according to claim 1, wherein an exciting circuit or a measuring circuit has terminals connected to the vibrating membrane and the conductive element, the exciting circuit or the measuring circuit furthermore being configured to apply a potential difference with a DC component or a component at a frequency lower than 50 Hz.

* * * * *